United States Patent [19]

Stubblefield

[11] 4,205,289

[45] May 27, 1980

[54] VAPORIZATION COOLED ELECTRICAL INDUCTIVE APPARATUS

[75] Inventor: Thomas W. Stubblefield, South Boston, Va.

[73] Assignee: Electric Power Research Institute, Inc., Palo Alto, Calif.

[21] Appl. No.: 900,040

[22] Filed: Apr. 25, 1978

[51] Int. Cl.[2] ..... H01F 27/10

[52] U.S. Cl. ..... 336/57; 336/58; 336/94

[58] Field of Search ..... 174/14 R, 15 R; 336/55, 336/57, 58, 60, 90, 94, 92; 165/105

[56] References Cited

U.S. PATENT DOCUMENTS

| | | | |
|---|---|---|---|
| 1,557,283 | 10/1925 | Horelick | 336/94 X |
| 2,481,134 | 9/1949 | Mallett | 336/94 X |
| 2,961,476 | 11/1960 | Moslin et al. | 165/105 X |
| 3,208,019 | 9/1965 | Stigant et al. | 336/58 |
| 3,234,493 | 2/1966 | Zwelling et al. | 336/94 |
| 3,243,495 | 3/1966 | Mazza | 174/15 R |
| 3,261,905 | 7/1966 | Allen | 336/57 X |
| 3,371,299 | 2/1968 | Radkowski et al. | 336/57 |
| 3,448,422 | 6/1969 | Derippe | 336/94 |
| 3,496,502 | 2/1970 | Moore | 336/59 |
| 3,668,583 | 6/1972 | Nichols | 336/58 |
| 4,009,417 | 2/1977 | Waldon et al. | 174/15 R X |

FOREIGN PATENT DOCUMENTS

| | | | |
|---|---|---|---|
| 664949 | 1/1952 | United Kingdom | 336/58 |

*Primary Examiner*—Thomas J. Kozma
*Attorney, Agent, or Firm*—D. R. Lackey

[57] ABSTRACT

Electrical inductive apparatus cooled by a two-phase dielectric fluid which vaporizes within the normal operating temperature range of the apparatus. The electrical inductive apparatus consists of a sealed enclosure surrounding a magnetic core and electrical winding assembly. A non-condensable gas fills a major portion of the enclosure at no-load conditions to provide adequate dielectric strength around the apparatus and is substantially removed to a storage tank when the apparatus reaches normal operating conditions. The required volume of the storage reservoir is proportional to the free volume of the enclosure and the volume of liquid dielectric disposed therein. The bottom surface of the enclosure includes a recessed channel portion configured to closely surround the lower yoke of the magnetic core and which serves to reduce the amount of liquid dielectric utilized and the free volume of the enclosure thereby minimizing the required volume of the storage reservoir for the non-condensable gas.

9 Claims, 4 Drawing Figures

VAPORIZATION COOLED ELECTRICAL INDUCTIVE APPARATUS

BACKGROUND OF THE INVENTION

1. Field of the Invention

This invention relates, in general, to electrical apparatus and, more specifically, to vaporization cooled electrical inductive apparatus.

2. Description of the Prior Art

Vaporization cooling systems have been proposed for electrical inductive apparatus, such as power transformers, which utilize a two-phase dielectric fluid having a boiling point within the normal operating temperature range of the electrical inductive apparatus. The dielectric fluid is applied to the electrical inductive apparatus in its liquid state, whereon it evaporates as it contacts the heat producing members and removes heat in quantities equal to the latent heat of vaporization of the dielectric fluid. The resulting vapors are then condensed and reapplied to the heat producing elements in a continuous cycle. In addition to providing cooling, the dielectric fluid also provides the necessary dielectric strength between the electrical elements in its vapor phase at the normal operating temperature and pressure of the electrical inductive apparatus.

Since dielectric fluids having the above-described properties are extremely expensive, economics dictate that such fluids be used in minimal amounts. Thus, prior art vaporization cooling systems utilize relatively small quantities of vaporizable dielectric fluids which are collected in a sump in the bottom of the enclosure and applied to the electrical winding by means of a pump, as shown by U.S. Pat. Nos. 2,961,476 and 3,261,905.

Since the dielectric strength of the vaporizable fluids is directly proportional to the pressure existing within the enclosure, it is common to add a second dielectric fluid, typically a gas which is substantially noncondensable over the operating temperature and pressure range of the apparatus, such as sulfur hexafluoride ($SF_6$), in sufficient quantities to provide adequate dielectric strength between the electrical elements in the enclosure when the apparatus is deenergized or operating at light loads and substantially all of the vaporizable fluid is in the liquid phase. As the transformer approaches its normal operating temperature, the non-condensable gas must be removed from the enclosure and stored in a separate tank, as shown in U.S. Pat. Nos. 2,961,476 and 4,011,535, since it interferes with the vaporization cooling cycle. Since the non-condensable gas fills a major portion of the enclosure when the apparatus is deenergized or operating at a light load, a storage reservoir or tank, having a large internal volume, is required to store the amount of non-condensable gas originally contained within the transformer enclosure. As the rating and sizes of transformers having vaporization cooled systems have increased, the size of a storage reservoir required for the non-condensable gas also has increased which, therefore, increases the overall size of the electrical inductive apparatus. Although they effectively provide for the separation of the non-condensable gas from the vaporizable liquid, none of the above-cited references provide any means for reducing the size of the storage reservoir required for the non-condensable gas.

Thus, it would be desirable to provide a vaporization cooled electrical apparatus wherein the volume of the storage reservoir required for the non-condensable gas is reduced over prior art apparatus of this type. It would also be desirable to provide a vaporization cooled electrical apparatus wherein more effective use is made of the small quantity of vaporizable dielectric fluid utilized in such apparatus.

SUMMARY OF THE INVENTION

Herein disclosed is a new and improved electrical inductive apparatus wherein cooling is provided by a two-phase vaporizable dielectric fluid. The electrical inductive apparatus consists of a sealed enclosure which surrounds a magnetic core having electrical windings disposed in inductive relation therewith. The bottom surface of the enclosure is formed to include a longitudinally extending, recessed channel portion in which the lower yoke of the magnetic core is situated. The channel thus forms a sump around the lower yoke of the magnetic core. A two-phase dielectric fluid, vaporizable within the normal operating temperature range of the electrical inductive apparatus, is disposed in the enclosure to fill at least a portion of the channel portion of the bottom surface of the enclosure. In addition, a gas, substantially non-condensable over the operating temperature and pressure range of the electrical inductive apparatus, is disposed in the enclosure to maintain a constant level of dielectric strength between the conducting members of the apparatus.

In operation, the dielectric fluid is transferred by a pump and distribution device from the channel portion of the bottom of the enclosure onto the electrical windings and the magnetic core. A portion of the dielectric fluid vaporizes as it contacts the heat producing members thereby removing heat in quantities equal to the latent heat of vaporization of the dielectric fluid. The non-condensable gas and the evolved vapors of the vaporizable dielectric fluid flow into a radiator wherein the vapors condense and flow back into the enclosure; while the non-condensable gas, which has a lower density than the vapors of the vaporizable dielectric fluid, rises to the top of the radiator and flows into a storage reservoir. As the load on electrical inductive apparatus is reduced, the non-condensable gas flows back into the enclosure to maintain a constant level of dielectric strength between the conducting members therein.

By constructing the bottom of the enclosure to include a recessed channel wherein the lower yoke of the magnetic core is disposed, the volume within the enclosure between the electrical windings and the raised portion of the bottom surface between the side walls and the channel is reduced. This reduction in the free volume of the enclosure is attained without the need for additional filler materials as commonly used in some prior art apparatus of this type and, further, enables the volume of the storage reservoir for the non-condensable gas to be significantly reduced thereby reducing the overall dimensions of the electrical inductive apparatus. In addition, by mounting the lower yoke of the magnetic core in the channel formed in the bottom surface of the enclosure, the temperature of that portion of the magnetic core is reduced without the addition of large amounts of the vaporizable dielectric fluid to the enclosure. Since the vaporizable fluid is more effectively utilized, smaller amounts of this expensive fluid are required for efficient cooling which, in turn, further contributes to the reduction in the required volume of the non-condensable gas storage reservoir. Further, by immersing a portion of the lower yoke of a magnetic core in the vaporizable dielectric fluid, the magnetic core acts as a heat source and produces vapors which may be used to start non-mechanical vapor lift pumps proposed for apparatus of this type.

BRIEF DESCRIPTION OF THE DRAWINGS

The various features, advantages and additional uses of this invention will become more apparent by referring to the following detailed description and the accompanying drawings, in which.

DESCRIPTION OF THE PREFERRED EMBODIMENT

In the following description, identical reference numbers refer to the same component shown in all figures of the drawings.

Figure 1:
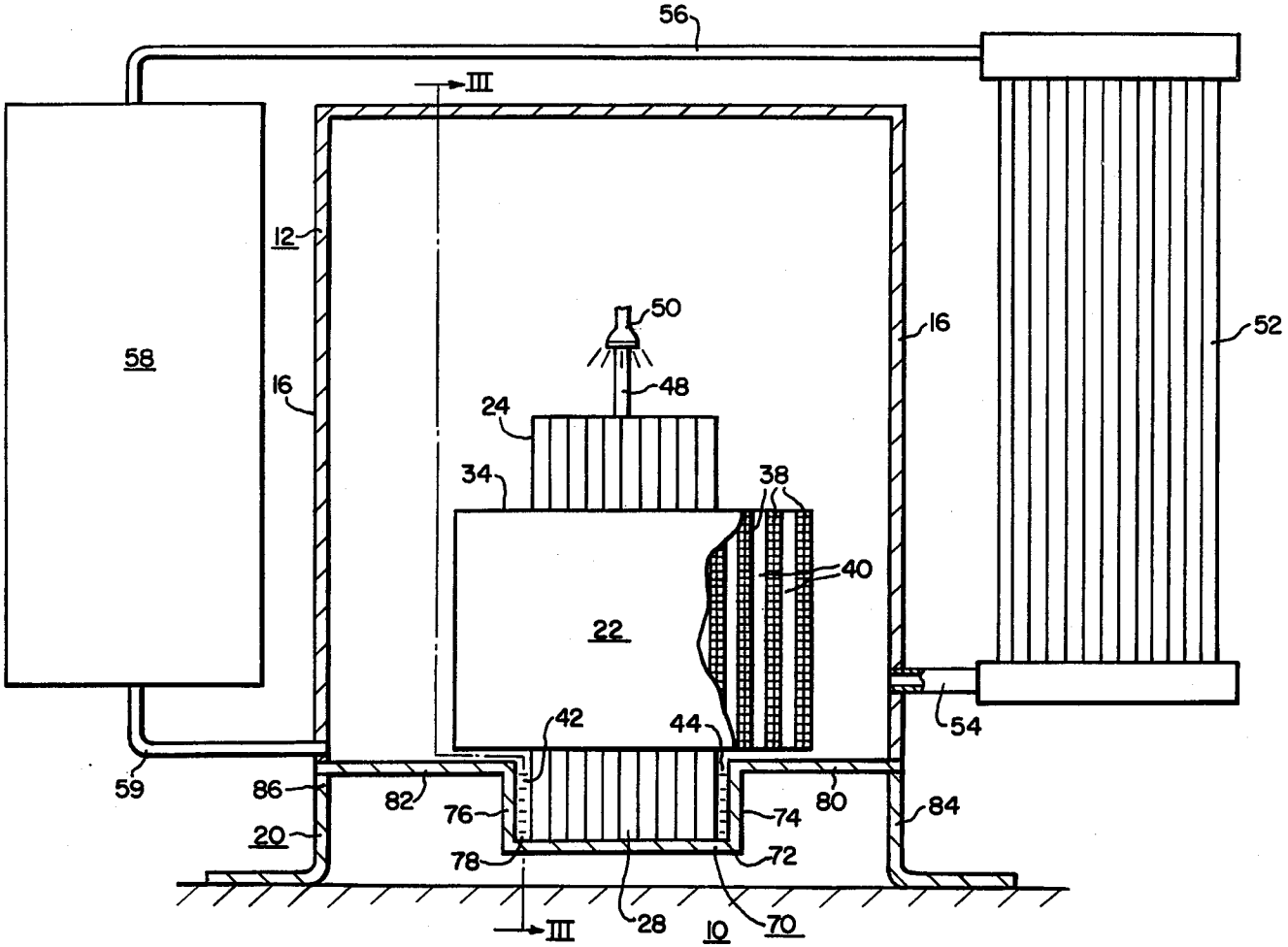
FIG. 1 is an elevational view, partially in section, of one embodiment of an electrical inductive apparatus constructed according to the teachings of this invention.

Referring now to FIG. 1, there is shown an electrical inductive apparatus 10, such as a power transformer, constructed according to one embodiment of this invention. The electrical inductive apparatus 10 consists of a sealed enclosure or housing 12 having top, side and bottom surfaces 14, 16 and 20, respectively. The housing 12 surrounds a magnetic core and electrical winding assembly 22. The magnetic core and winding assembly 22 includes a magnetic core 24 formed of a plurality of laminations of suitable magnetic material. As shown more clearly in FIG. 3, the laminations of magnetic material are arranged to form top and bottom yokes 26 and 28, respectively, which connect vertically extending, longitudinally spaced legs 30 and 32 to form a closed magnetic path.

The magnetic core and coil assembly 22 further includes phase windings 34 and 36 which are both representative of high and low voltage electrical windings. Each phase winding 34 and 36 consists of electrical conductors formed of suitable electrically conductive material, such as aluminum or copper, and of either round wire, strap or sheet type, which form a plurality of turns or layers 38, as shown in FIG. 1, around the vertically extending legs 30 and 32 of the magnetic core 24. A plurality of vertically extending cooling ducts 40 are formed by suitable means between certain of the layers 38 of the phase windings 34 and 36 to form fluid-flow passages through the windings 34 and 36 for a dielectric fluid coolant as described hereafter.

For clarity, the electrical leads and bushings normally used to connect the phase windings 34 and 36 to an external electrical circuit are not shown. In addition, while a single-phase transformer of the core-form type has been illustrated, it will be understood that the teachings of this invention apply equally as well to single or polyphase electrical apparatus, as well as reactors and any high voltage electrical apparatus wherein electrical conductors are cooled by a vaporizable dielectric fluid.

Figure 3:
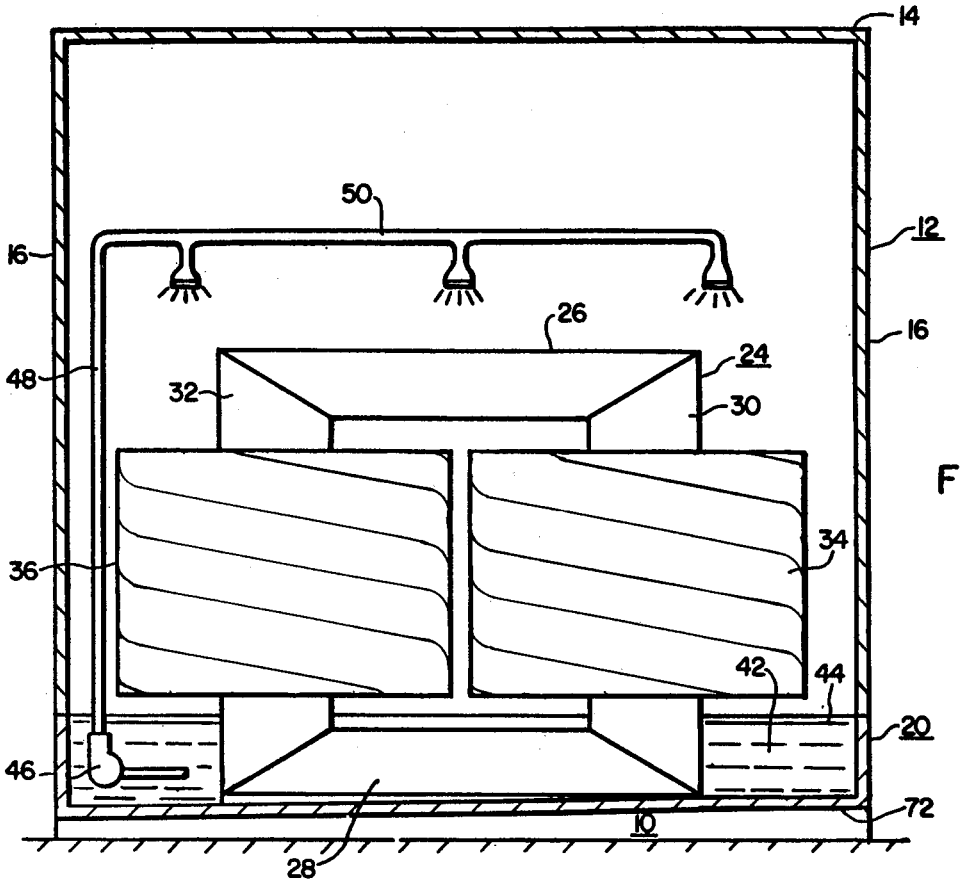
FIG. 3 is a sectional view, generally taken along line III—III in FIG. 1, illustrating additional features of this invention.

The magnetic core and coil assembly 22 is cooled by a two-phase dielectric fluid 42 which has its boiling point within the normal operating temperature range of the magnetic core and coil assembly 22. In addition to providing adequate cooling, the dielectric fluid 42 also provides electrical insulation in its vapor phase between the turns of the phase windings 34 and 36 at the normal operating temperatures and pressures of the transformer 10. As known to those skilled in the art, fluid dielectrics with the above-described properties generally include, but are not limited to, the inert fluorinated organic compounds. Examples of such compounds that may be used to practice this invention are listed in detail in U.S. Pat. No. 2,961,476. Since these types of dielectric fluids are quite costly, economics dictate that the amount of such fluids used to cool the transformer 10 be minimized. Accordingly, a small quantity of the dielectric fluid 42 is disposed within the enclosure 12 to a level 44 above the bottom surface 20 of the enclosure 12, as shown in FIG. 1. Since a minimal amount of the dielectric fluid 42 is utilized to cool the transformer 10, suitable means for reapplying the dielectric fluid 42 to the phase windings 34 and 36 of the transformer 10 is provided. As shown in FIG. 3, the supply means includes a pump 46, a conduit 48 and a distribution device 50. The pump 46 transfers the liquid dielectric 42 from the bottom of the enclosure 12 through conduit 48 to the distribution device 50 situated above the phase windings 34 and 36 of the transformer 10 which provides a uniform distribution of the dielectric fluid 42 over the cooling ducts 40 within the phase windings 34 and 36. Although the distribution device 50 is illustrated as being of the spray type, it will be understood that any other distribution means capable of providing a uniform distribution of dielectric liquid may be used as well.

In operation, the dielectric fluid 42 will be applied uniformly by the distribution device 50 over the ducts 40 within the phase windings 34 and 36 of the transformer 10. The dielectric fluid 42 will flow through the ducts 40 and will evaporate as it contacts the heat producing windings 34 and 36 thereby cooling the windings 34 and 36 by removing heat in quantities equal to the latent heat of vaporization of the dielectric fluid 42. The evolved vapors of the dielectric fluid 32 will flow through the ducts 40 into the interior of the enclosure 12 whereon a portion will condense on the walls of the enclosure 12 and flow back into the bottom portion of the enclosure 12. A larger portion of the evolved vapors will flow into a cooling means 52, such as a radiator or cooler, which is disposed in fluid flow communication with the enclosure 12 through conduit 54. The vapors will condense on the exposed cooling surfaces of the radiator 52 and will flow back through conduit 54 into the enclosure 12 to be recirculated in a continuous cycle.

As is well known, the dielectric properties of the vaporizable fluids that may be used in the preferred embodiment of this invention are directly proportional to the pressures and temperatures existing within the enclosure 12 of the transformer 10. When the transformer 10 is initially energized or operating at light loads, only a small portion of the dielectric fluid 42 is in the gaseous or vapor state which thereby provides an insufficient amount of dielectric strength between the conducting members of the transformer 10. Accordingly, a second dielectric fluid, not shown, is utilized in combination with the vaporizable dielectric fluid 42 to provide the necessary dielectric strength for the transformer 10 during periods of light loads or initial energization. This fluid is typically a gas which is substantially non-condensable over the operating temperature and pressure range of the transformer 10. The gas, such as sulfur hexafluoride ($SF_6$), fills a major portion of the volume of the enclosure 12 at no-load conditions to provide the necessary dielectric strength between the conducting members of the transformer 10.

As load is applied to the transformer 10, increasing quantities of the dielectric fluid 42 will be vaporized, thereby increasing the pressure within the enclosure 12. This increased pressure will cause the mixture of non-condensable gas and vaporized dielectric fluid 42 to flow from the enclosure 12 into the radiator 52 wherein the vapors of the vaporizable dielectric fluid 42 will condense and flow back into the enclosure 12. Since the non-condensable gas utilized in the preferred embodiment of this invention has a lower density than the vapors of the dielectric fluid 42, the non-condensable gas will rise to the upper portion of the radiator 52 and will flow through conduit 56 to a suitable storage means 58, such as a tank or reservoir, thereby effectively separating it from the vaporized dielectric fluid 42 during the normal operation of the transformer 10. As load is removed from the transformer 10, the non-condensable gas will gradually flow from the storage tank 58 back into the enclosure 12 to maintain a constant level of dielectric strength between the conducting members of the transformer 10. A drain conduit 59 is provided between the tank 12 and the storage reservoir 58 to permit any vapors of the vaporizable fluid 42 present in the storage reservoir 58 to flow back into the main tank 12.

Although the storage tank 58 is illustrated as being in fluid communication with the radiator 52, it is apparent that it may be disposed in direct fluid communication with the tank 12 to separate the non-condensable gas from the vapors of the dielectric fluid 42.

Since the non-condensable gas fills a major portion of the volume of the enclosure 12 at no-load conditions and, further, since substantially all of this gas is removed from the enclosure 12 when the transformer reaches its normal operating conditions, the storage tank 58 must have sufficient capacity or volume to store all of the non-condensable gas initially present in the tank 12. The desired increase in ratings of transformers utilizing vaporization cooling systems has resulted in larger enclosure dimensions. Accordingly, additional quantities of non-condensable gas are required to fill the enclosure when the transformer is de-energized or operating at lights loads which, in turn, necessitates larger storage tanks to hold the non-condensable gas when it is removed from the enclosure 12. These larger storage tanks have increased the overall dimensions of the electrical inductive apparatus beyond acceptable limits.

Before describing the novel features of this invention, several fundamental principles will be presented in order to provide a better understanding of this invention. The volume of the storage tank 58 required to store the desired amount of non-condensable gas is given by:

$$V_S = \frac{V_E + K_1 V_L}{K_2 K_3 - 1}$$

where $V_S$ is the volume of the storage reservoir 58, $V_E$ is the free volume of the enclosure 12, including the radiator 52, if any, and excluding the magnetic core and coil assembly, $K_1$ is a constant equal to $(\phi-1)/(1-\beta\phi)$ wherein $\phi$ is a ratio of the volume of the non-condensable gas absorbed in a unit volume of the particular liquid dielectric 42 used and $\beta$ is a ratio of the density of the vapors of the liquid dielectric 42 to the density of the liquid dielectric, $V_L$ is the volume of the liquid dielectric 42, $K_2$ is a constant equal to $(1-\beta)/(1-\beta\phi)$, $K_3$ is equal to $T_1P_2/T_2P_1$ wherein $T_1$ and $P_1$ respectively are the temperature and partial pressure of the non-condensable gas at no-load conditions and $T_2$ and $P_2$ are the temperature and pressure of the non-condensable gas at normal operating conditions. For temperatures less than 30° C., which are within the normal operating temperatures of apparatus of this type, $\beta$ is relatively small and may be set equal to zero without significantly affecting the accuracy of the above relationship.

It is the purpose of this invention to provide an electrical inductive apparatus having a smaller free volume and utilizing a smaller amount of vaporizable liquid than prior art apparatus of a similar type. The reduction in the free volume of the enclosure and the volume occupied by the vaporizable fluid, as described hereafter, results in an even greater reduction in the required volume of the storage tank for the non-condensable gas which, in turn, reduces the overall dimensions of the electrical inductive apparatus.

As shown in FIG. 1, the bottom surface 20 of the enclosure 12 includes a centrally located channel 70 which extends the entire longitudinal length of the transformer 10. The channel 70 in the bottom surface 20 of the enclosure 12 has a substantially U-shaped cross-sectional configuration consisting of a first transverse portion 72 disposed between first and second axially extending portions 74 and 76, respectively. The first and second axially extending portions 74 and 76 surround and are spaced from the lower yoke 28 of the magnetic core 24 to form a sump 78 therearound. The dielectric fluid 42 is utilized in sufficient quantities to fill at least a portion of the sump 78 formed around the lower yoke 28 of the magnetic core 24. The bottom surface 20 of the enclosure 12 further includes second and third transverse portions 80 and 82, respectively, which extend between the first and second axially extending portions 74 and 76, respectively, and the side walls 16 of the enlcosure 12. The second and third transverse portions 80 and 82, respectively, are suitably joined to the side walls 16 of the enclosure 12 at their periphery to form a fluid-tight seal therearound. In addition, flanges 84 and 86 are formed in the bottom surface 20 of the enclosure 12 to provide legs to support the enclosure 12.

By providing a stepped-down or recessed channel portion 70 in the bottom surface 20 of the enclosure 12, the volume between the bottom of the phase windings 34 and 36 and the second and third transverse portions 80 and 82, respectively, of the bottom surface 20 is reduced. This reduction in the free volume of the enclosure 12 results, for the vaporizable fluids and non-condensable gases described above, in a significant reduction in the volume of the storage tank 58 since for every cubic foot eliminated from the volume of the enclosure 12, a greater amount of volume may be eliminated from the storage tank 58.

A specific example will now be presented to clarify the teachings and advantages of this invention. A 2500 KVA vaporization cooled transformer with an enclosure having a flat bottom would typically have a free volume, including the radiator, of 47.1 $ft^3$ and would require 6.5 $ft^3$ of vaporizable liquid for adequate cooling and to provide sufficient head to operate a pump. In addition, for the vaporizable liquids listed above, $\phi$ would typically be approximately 6.7. A 2500 KVA transformer having an enclosure constructed according to the teachings of this invention with a recessed channel in the bottom surface thereof, would have a free volume, including the radiator, of 44.5 $ft^3$ and would require only 3.9 $ft^3$ of vaporizable liquid for efficient cooling. By forming a ratio of the volumes of the storage tanks required for both transformer configurations and solving the aforementioned equation in each case with the appropriate values, it will be seen that the volume of the storage tank required for a transformer constructed according to the teachings of this invention is 21% less than the volume of a storage tank for transformers having a flat bottom surface. This 21% reduction in the volume of the storage tank is achieved by only a 5% reduction in the free volume of the enclosure which is provided by the recessed channel configuration of the bottom surface of the enclosure. Further, a transformer constructed according to the teachings of this invention utilizes 40% less vaporizable liquid which, besides reducing the expense of such liquid, also contributes to the reduction in the required volume of the storage tank since the smaller amount of vaporizable liquid absorbs a smaller amount of the non-condensable gas.

Figure 2:
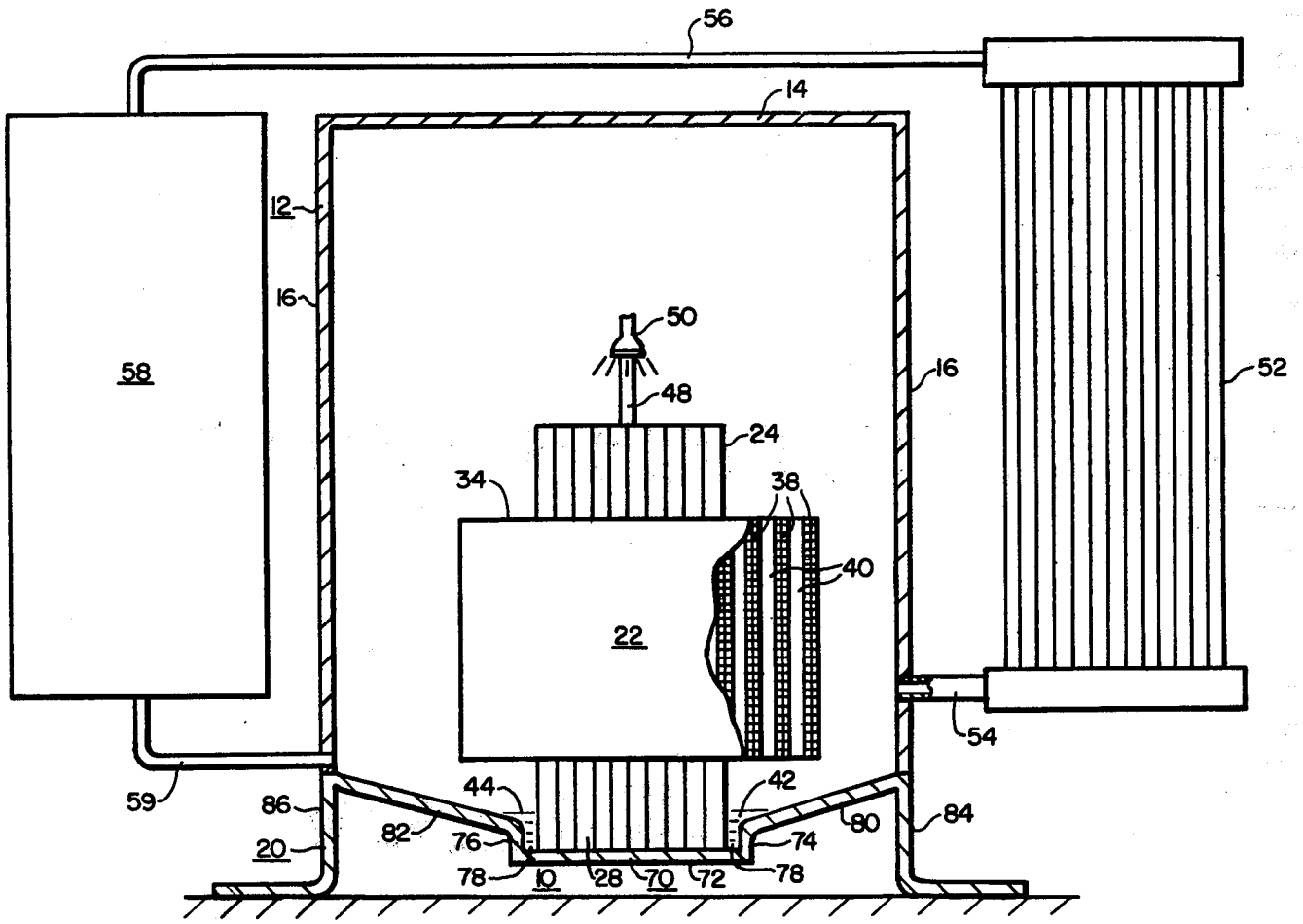
FIG. 2 is an elevational view, partially in section, of an electrical inductive apparatus constructed according to another embodiment of this invention.

As shown in FIG. 1, the second and third transverse portions 80 and 82, respectively, of the bottom surface 20 are substantially perpendicular to the first and second axially extending portions 74 and 76 and are substantially horizontal, as viewed in FIG. 1, to provide the maximum reduction in the free volume of the enclosure 12. According to another embodiment of this invention, the second and third transverse portions 80 and 82 of the bottom surface 20 of the enclosure 12 may be disposed at a predetermined angle other than perpendicular with respect to the first and second axially extending portions 74 and 76 of the bottom surface 20, as shown in FIG. 2. In this embodiment, the second and third transverse portions 80 and 82, respectively, define a downwardly extending slope or incline between the side walls 16 of the enclosure 12 and the channel portion 70 of the bottom surface 20 which directs the condensed vapors of the dielectric fluid 42 to the sump 78 formed by the channel portion 70 of the bottom surface 20 around the lower yoke 28 of the magnetic core 24.

This embodiment is particularly advantageous since, when it is installed at the customer's site, the transformer may not be exactly level. Due to the small amounts of vaporizable dielectric fluids utilized in apparatus of this type, the slightest deviation from horizontal would cause the dielectric fluid to accumulate in one portion of the tank and thereby result in uneven or insufficient cooling of the transformer. However, the downward slope configuration of the bottom surface 20 of the enclosure 12 overcomes this potential problem by directing the dielectric fluid into the sump 78 around the core thereby maintaining cooling efficiency despite an unlevel installation.

Referring now to FIG. 3, there is shown another embodiment of this invention wherein the longitudinally extending first transverse portion 72 of the bottom surface 20 of the enclosure 12 is disposed at a predetermined angle with respect to the horizontal, as viewed in FIG. 3. In this manner, the first transverse portion 72 of the bottom surface 20 defines a longitudinally extending slope or incline in the channel 70 in the bottom surface 20 which directs the dielectric fluid 42 to the pump 46 situated at one end of the channel 70 and thereby reduces the amount of dielectric fluid 42 required to adequately cool the transformer 10. Also, the slope in the first transverse portion 72 of the bottom surface 20 directs the dielectric liquid towards the pump 46 despite an unlevel installation of the transformer 10 at the customer's site.

Figure 4:
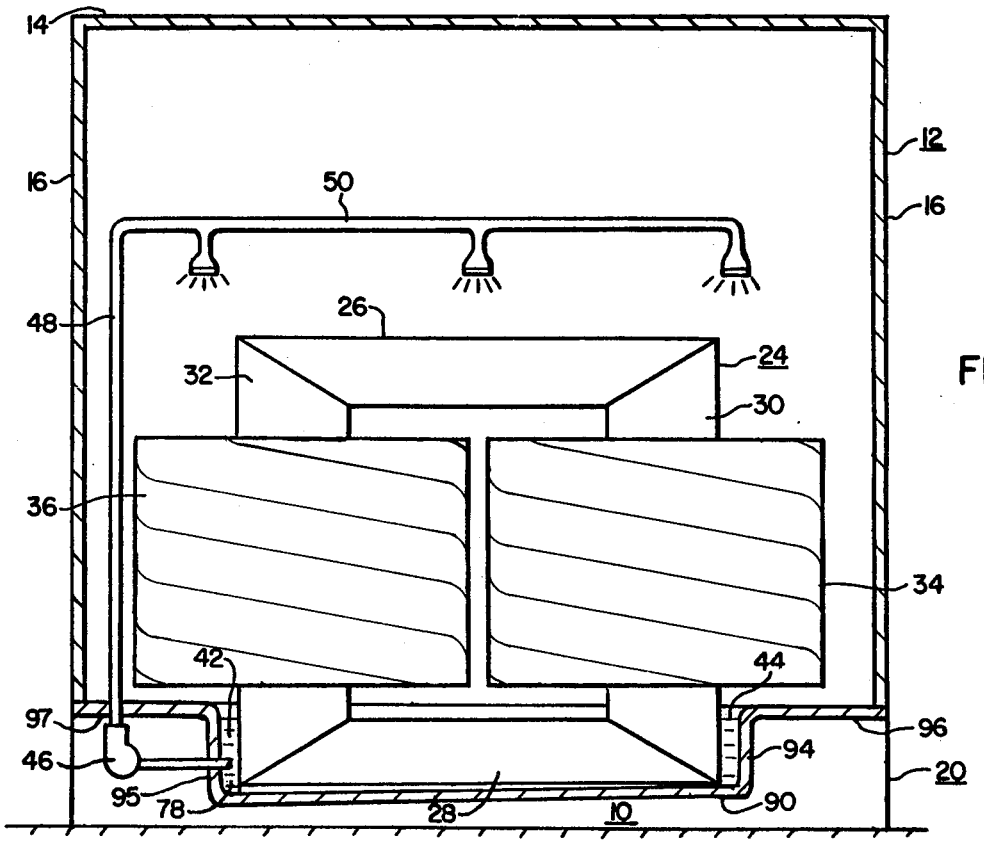
FIG. 4 is a sectional view, similar to FIG. 3, showing another embodiment of this invention.

Another embodiment of this invention is illustrated in FIG. 4 which is identical to that shown in FIG. 3 with the exception that the first transverse portion 90 of the bottom surface 20 has a substantially U-shaped cross-sectional configuration along its longitudinal length. The first transverse portion 70 of the bottom surface 20, shown in FIG. 4, includes a transverse portion 90 disposed below and supporting the lower yoke 28 of the magnetic core. Axial extending portions 94 and 95 extend upwardly from the longitudinal ends of the first transverse portion 90 and are spaced from the magnetic core to form the sides of the sump 78 therearound. Additional transverse portions 96 and 97, which are on substantially the same plane as the second and third transverse portions 80 and 82 shown in FIG. 1, extend from the axial extending portions 94 and 95 to the side walls 16 of the enclosure 12. In this embodiment, the sump forms a recessed box-like cavity in the bottom surface 20 of the enclosure 12 and closely surrounds the entire periphery of the lower yoke of the magnetic core which further reduces the amount of vaporizable dielectric fluid 42 required and the free volume of the enclosure 12.

It will be apparent to those skilled in the art that there is disclosed herein a new and improved vaporization cooled electrical inductive apparatus. By providing an enclosure having a bottom surface with a longitudinally extending, recessed channel portion therein which surrounds the lower yoke of the magnetic core and forms a sump therearound, the free volume of the enclosure is significantly reduced over prior art apparatus of this type. This reduction in the free volume of the enclosure 12 enables an even greater reduction in the volume of the storage tank 58 for the non-condensable gas to be realized since every cubic foot of volume eliminated from the enclosure 12 reduces the volume of the storage tank 58 by approximately 1.2 to 2.5 cubic feet. In addition, by disposing the lower yoke of a magnetic core in the sump formed by the channel portion of the bottom surface of the enclosure, the lower portion of the magnetic core is constantly immersed in the liquid dielectric fluid which reduces the temperature of this portion of the magnetic core without requiring additional amounts of dielectric fluid. Since the vaporizable dielectric fluid is more effectively used, a smaller amount of such fluid is required to provide adequate cooling which, in turn, further contributes to the reduction in the required volume of the non-condensable gas storage tank. Furthermore, by constantly immersing the lower yoke of the magnetic core in the liquid dielectric fluid, the lower yoke acts as a heat source and provides vapors which may be used to start various non-mechanical vapor lift pumps proposed for vaporization cooled apparatus of this type.

What is claimed is:

1. Electrical inductive apparatus comprising:

an enclosure;

a magnetic core and winding assembly disposed in said enclosure including a lower yoke portion disposed beneath the winding assembly and producing heat during normal operation;

a liquid dielectric disposed in said enclosure to a predetermined level, said liquid dielectric being vaporizable within the normal operating temperature range of said magnetic core and winding assembly;

a storage reservoir disposed in fluid flow communication with said enclosure; and a gaseous dielectric substantially non-condensable over the operating temperature and pressure range of said magnetic core and winding assembly, said gaseous dielectric being transferable between said enclosure and said storage reservoir in response to pressure within said enclosure provided by the vapors of said liquid dielectric, with said gaseous dielectric filling substantially all of said enclosure at a first predetermined temperature and substantially all of said gaseous dielectric being within said storage reservoir at a second predetermined temperature, which temperatures are within the operating temperature range of said magnetic core and winding assembly;

a portion of said gaseous dielectric being absorbed into said liquid dielectric at said first predetermined temperature and released into said enclosure at said second predetermined temperature with a resulting increase in volume of said gaseous dielectric;

said enclosure including a bottom surface having a channel portion which defines a recess having said lower yoke portion disposed therein, and which laterally surrounds the yoke portion in said recess in spaced relationship therewith, thereby reducing the free volume of said enclosure, with the space between said lower yoke portion and said channel portion forming a sump for said liquid dielectric thereby reducing the volume of said liquid dielectric necessary to fill said enclosure to said predetermined level, whereby the reduction in both the free volume of said enclosure and the volume of said liquid dielectric reduces the required volume of said storage reservoir necessary to contain substantially all of said gaseous dielectric at said second predetermined temperature, wherein the reduction in the required volume of said storage reservoir is substantially greater than the total reduction of the free volume of said enclosure plus the reduction in volume of said liquid dielectric, said storage reservoir having a required volume which is proportional to the free volume of said enclosure and the volume of said liquid dielectric and is given by:

$$V_S = \frac{V_E + K_1 V_L}{K_2 K_3 - 1}$$

where $V_S$ is the required volume of said storage reservoir, $V_E$ is the free volume of said enclosure excluding the volume of said magnetic core and winding assembly, $K_1=(\phi-1)/(1-\beta\phi)$ wherein $\phi$ is a ratio of the volume of said gaseous dielectric absorbed per unit volume of said liquid dielectric and $\beta$ is a ratio of the density of the vapors of said liquid dielectric to the density of said liquid dielectric, $V_L$ is the volume of said liquid dielectric, $K_2$ is a constant equal to $(1-\beta)/(1-\beta\phi)$, $K_3$ is a constant equal to $T_1P_2/T_2P_1$ wherein $T_1$ and $P_1$ respectively are the temperature and partial pressure of said gaseous dielectric at said first temperature and $T_2$ and $P_2$ are the temperature and partial pressure of said gaseous dielectric at said second temperature.

2. The electrical inductive apparatus of claim 1 wherein the liquid dielectric fills only a portion of the channel portion of the bottom surface of the enclosure.

3. The electrical inductive apparatus of claim 2 including means for supplying the liquid dielectric from the channel portion of the enclosure to the magnetic core and winding assembly, said supplying means including:

distribution means, disposed above said magnetic core and winding assembly, for uniformly distributing said liquid dielectric thereover; and pump means, disposed in fluid flow communication between said channel portion of said enclosure and said distribution means, for transferring said liquid dielectric therebetween.

4. The electrical inductive apparatus of claim 1 wherein the channel portion in the bottom surface of the enclosure has a substantially U-shaped cross-sectional configuration formed by:

a first transverse portion disposed beneath the lower yoke of the magnetic core and winding assembly; and first and second axially extending portions disposed on opposite ends of sad first transverse portion and spaced from said lower yoke of said magnetic core and winding assembly to form a sump therebetween.

5. The electrical inductive apparatus of claim 4 wherein the first transverse portion of the bottom surface of the enclosure is disposed at a predetermined angle with respect to the horizontal, to provide a slope in the longitudinal direction.

6. The electrical inductive apparatus of claim 4 wherein the first transverse portion of the bottom surface of the enclosure further includes:

a longitudinally extending transverse portion disposed beneath the magnetic core and winding assembly;

third and fourth axially extending portions disposed on opposite ends of said longitudinally extending transverse portion of said first transverse portion and spaced from said lower yoke of said magnetic core and winding assembly to form opposing ends of the sump therebetween; and fourth and fifth transverse portions extending between said third and fourth axially extending portions and the sides of said enclosure.

7. The electrical inductive apparatus of claim 4 wherein the bottom surface of the enclosure further includes second and third transverse portions extending between the first and second axially extending portions and the sides of said enclosure adjacent thereto.

8. The electrical inductive apparatus of claim 7 wherein the second and third transverse portions of the bottom surface are substantially perpendicular to the first and second axially extending portions thereof.

9. The electrical inductive apparatus of claim 7 wherein the second and third transverse portions of the bottom surface are disposed at a predetermined angle between the sides of the enclosure and the first and second axially extending portions of said bottom surface to direct the liquid dielectric into the channel in said bottom surface of said enclosure.

* * * * *